US006363941B1

(12) United States Patent
Combs

(10) Patent No.: US 6,363,941 B1
(45) Date of Patent: Apr. 2, 2002

(54) CIGAR HOLDER

(76) Inventor: Donald R. Combs, 9714 Morningfield, San Antonio, TX (US) 78250

( * ) Notice: Subject to any disclaimer, the term of this patent is extended or adjusted under 35 U.S.C. 154(b) by 0 days.

(21) Appl. No.: 09/610,075

(22) Filed: Jul. 5, 2000

(51) Int. Cl.[7] ..... A24F 13/02; A24F 9/14; A44B 1/04

(52) U.S. Cl. ..... 131/190; 131/257; 131/187; 24/67 R; 24/67.5; 24/67.7

(58) Field of Search ..... 24/67 R, 67.5, 24/568, 565, 67.3, 67.7, 326, 327, 67.9, 508, 545, 546, 563, DIG. 8–10; D19/86, 85; 131/240.1, 187, 190, 175, 257

(56) References Cited

U.S. PATENT DOCUMENTS

| | | | | | |
|---|---|---|---|---|---|
| 2,589,889 | A | * | 3/1952 | Stegeman | 24/67.5 |
| 4,063,731 | A | | 12/1977 | Kitay | 473/286 |
| 4,532,680 | A | * | 8/1985 | Hashimoto | 24/67 R |
| 4,627,621 | A | | 12/1986 | Tate | 473/286 |
| 4,696,081 | A | * | 9/1987 | Yen | 24/558 |
| D300,160 | S | | 3/1989 | Johnson | D21/793 |
| 4,838,285 | A | | 6/1989 | Petrone | 131/259 |
| 5,305,999 | A | | 4/1994 | Tate | 473/406 |
| 5,401,019 | A | | 3/1995 | Wissman | 473/286 |
| 5,533,236 | A | * | 7/1996 | Tseng | 24/67.5 |
| 5,706,832 | A | | 1/1998 | Gold | 131/240 |
| D395,731 | S | | 6/1998 | Olis | D27/192 |
| D405,224 | S | | 2/1999 | Falconio | D27/183 |
| 5,896,624 | A | * | 4/1999 | Horswell | 24/67.5 |
| 5,950,283 | A | * | 9/1999 | Sato | 24/67 R |

FOREIGN PATENT DOCUMENTS

| | | | |
|---|---|---|---|
| WO | WO 09942008 A1 | 8/1999 | A24F/13/22 |

OTHER PUBLICATIONS

K92025, May '98, Golfsmith Store Magazine, p.47 Cigar Ske.

K92024 May '98 Golfsmith Store Magazine p. 40 Gar–Tender.

* cited by examiner

*Primary Examiner*—James Derrington
*Assistant Examiner*—Dionne A. Walls

(57) ABSTRACT

A cigar holder is a large size 50 mm "binder clip" modified in a way to hold various sizes of cigars between the opposed gripping means above the clamping element. The device will clip onto a narrow surface up to 20 mm in diameter. The cigar holder includes a clamping element, a pair of opposed gripping means which when pressed together, open the clamping element for securing the device to any stationary surface 20 mm in diameter or less within the clamping elements. The improvement comprising two bends in the opposed gripping meand forming a shape that will receive and hold a cigar or golf club.

2 Claims, 1 Drawing Sheet

CIGAR HOLDER

CROSS-REFERENCE TO RELATED APPLICATIONS

Not Applicable.

BACKGROUND—FIELD OF INVENTION

The present invention relates to an improved golf accessory which can be utilized as a cigar holder as well as a golf club holder for use during a round of golf or at the practice range.

BACKGROUND—DESCRIPTION OF PRIOR ART

A variety of golf accessories with many different designs have been in existence for a number of years. For example, U.S. Pat. No. 4,063,731 (Kitay) discloses a multi-purpose golfer's tool. The tool provides a distance estimating facility, a divot tool and a dry-club grip support in addition to a cleat wrench, cleat cleaner and groove cleaner. The device also includes a tee-height gauge and a cigarette holder.

U.S. Pat. No. 4,838,285 (Petrone) discloses a golf tee having a substantially V-shaped groove for receiving and holding cigarettes, cigars or the handle of a golf club. The tee is inserted into the ground in the normal way and is used for supporting cigarettes, cigars or the handle of a golf club a distance above the ground so that such objects do not come in contact with dangerous chemicals which may be used on the grass of golf courses.

U.S. Pat. No. 4,627,621 (Tate) discloses a golf accessory which serves both as a divot tool and as a money clip. The clip can be used as a means of attachment of the accessory to the belt, cap, shoe or golf bag of a golfer in addition to being useful as a money clip. The accessory also includes a looped return beyond a disk-shaped body which defines a saddle facing upwardly. The saddle serves as a stand or prop for supporting the grip of a golf club above the grass in order to prevent the grip from becoming wet with moisture which may be on the turf.

U.S. Pat. No. 5,305,999 (Tate) also discloses a golf accessory which includes a projection in the top of which a transverse groove is defined. The transverse groove is of a size suitable for cradling a cigarette. The projection may be formed as a return bent back in a loop in order to form a clip for money, bills, or other papers. The backing plate may also be provided with recessed regions in which magnets may be mounted to receive disk-shaped ball markers. The device also includes a structure which may be used to clean the grooves in the face of a golf club.

U.S. Pat. No. 5,401,019 (Wissman) discloses a golf tool having a variety of uses. The tool includes a circular hole for checking the roundness of a golf ball which can also be used in the form of a ball retriever by fastening the tool to the end of a golf club. The tool includes two fingers for cleaning the grooves on the face of golf club heads or to repair ball-marks on golf greens. The tool can also be struck into the ground in an upright position such that a flattened portion on the top of the tool can be used to keep the handgrip of a golf club off wet grass. A slot in the tool may be used to hold a cigarette when the tool is struck in the ground in such an upright position.

U.S. Pat. No. 5,706,832 (Gold) shows a device which can handle any size cigar and can be secured th a golf car or golf bag but cannot be moved to an area around the tee boxes or greens on the golf course.

U.S. Design Pat. No. 300,160 (Johnson) discloses an ornamental design for a combined golfers green repairer, shoehorn, cleat tightner and cleaner, and golf club and cigarette rest. U.S. Design Pat. No. 405,224 (Falconio) shows a device that clips to a golf bag with a golf ball mounted on top. The golf ball has a concave portion at the top to hold a cigar and a hole through it to hold a cigarette. This device will not secure the cigar upon movement of the golf bag.

U.S. Design Pat. No. 395,731 (Olis) shows a golf ball with a hole drilled through the middle, mounted on top of a stake-like device for embedding into the ground. This device cannot be secured to a golf bag or golf car.

The Cigar Snake featured on page 47 of the May '98 issue of the Golfsmith Store magazine shows a flexible, twisting arm that wraps around virtually any object. This device will not secure the cigar in place when ridden over rough terrain. Cannot be inserted into the ground to hold a cigar or golf club off the ground around the Tee boxes or greens.

The Gar-Tender featured on page 40 of the May '98 issue of the Golfsmith Store magazine shows a device which will keep a cigar off the ground but is not easily transfered from the golf bag to the Tee boxes or greens.

While all of these golf accessories are useful for one purpose or another, there is still a need in the art for other types of golf accessories.

SUMMARY

In accordence with the present invention a cigar holder comprises an ordinary binder clip with a pair of modified opposed gripping means shaped to hold a cigar and a clamping element to secure the holding device.

OBJECTS AND ADVANTAGES

Accordingly, besides the objects and advavtages of the golf accessories described in my patent, several objects and advantages of the present invention are:

(a) to provide a temporary holder for a cigar or cigarette so the golfer's hands become free;

(b) to provide a temporary holder for a cigar or cigarette that allows the golfer to avoid putting their cigar or cigarette down on the grass where it comes in contact with dangerous pesticides and fertilizers on the golf course;

(c) to provide a temporary holder for a cigar or cigarette that allows the golfer a dry place to set their cigar, cigarette, or golf club if the grass on the golf course is wet;

(d) to provide a temporary holder for a cigar or cigarette that accomodates all sizes;

(e) to provide a temporary cigar or cigarette holder that is lightweight and durable.

DRAWING FIGURES

DESCRIPTION OF THE PREFERRED EMBODIMENT

Figure 1:
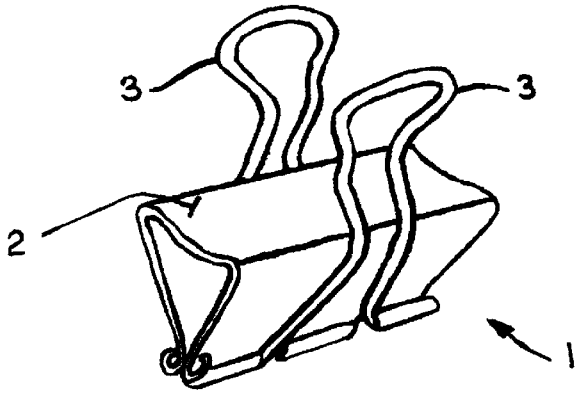
FIG. 1 is an isometric view of the inventive cigar holder in closed position, looking angularly downward theron.
Figure 2:
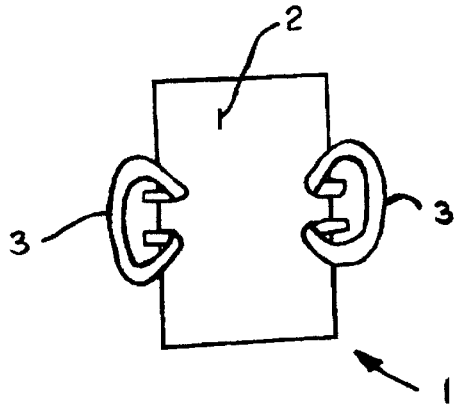
FIG. 2 is a top view of the cigar holder in closed position.

Referring to FIGS,1–5 of the drawings, the novel cigar holder broadly referred to by reference numeral 1, includes a clamping element 2. The clamping element 2 is opened and closed by a pair of opposed gripping means 3.

Figure 3:
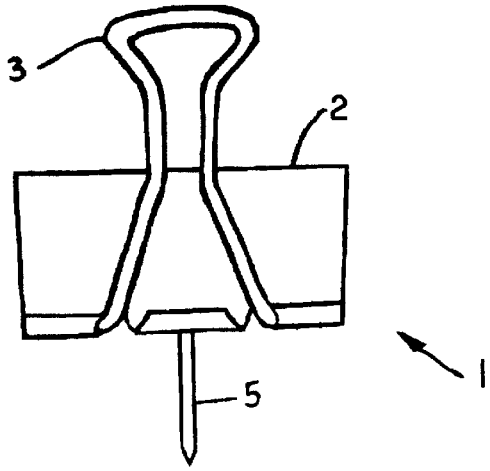
FIG. 3 is a side view of the cigar holder in closed position with a golf "Tee" held between the clamping element.

The cigar holder 1 secures to a narrow surface with the clamping element 2. The distal ends of the modified opposed gripping means 3 are compressed to open the clamping element 2 so that it may be clamped onto a narrow surface. The clamping element 2 is closed by releasing the modified opposed gripping means 3 and allowing the distal ends to seperate. The cigar holder 1 is held off the ground by inserting a golf "Tee" 5 between the clamping element 2 and embedding the tee 5 into the ground. The clamping element 2 is bent in a triangular cross-section, with a top surface forming the base of the triangle. The gripping means 3 have distal and proximal ends, the proximal ends being attached to abutting ends of the clamping element 2. See FIGS. 3 & 4.

Figure 5:
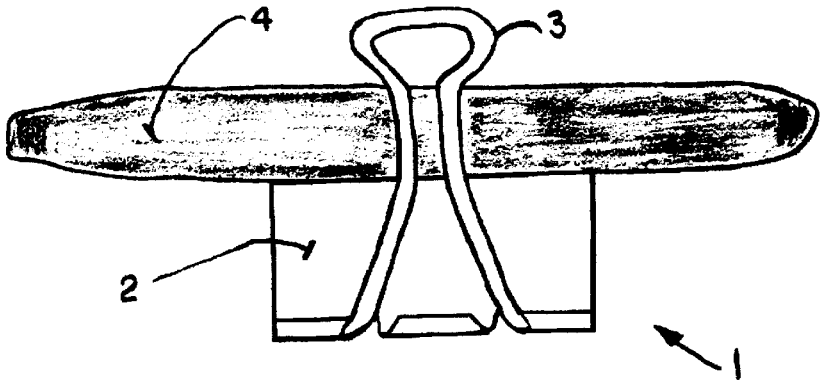
FIG. 5 is a side view of the cigar holder in closed position with cigar held atop the clamping element and between the modified opposed gripping means.

The cigar 4 is held in place on the cigar holder resting atop the clamping element 2, between the two modified opposed gripping means 3, when the cigar holder is secured in places See FIG. 5.

Figure 4:
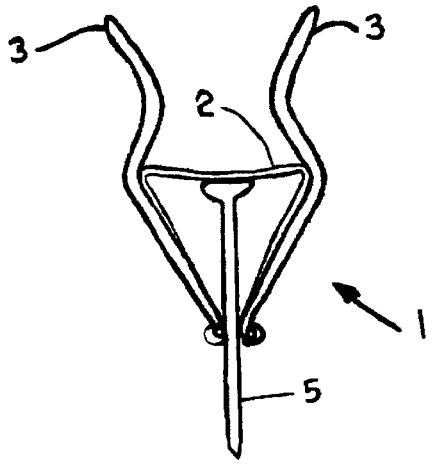
FIG. 4 is a frontal view of FIG. 1 with a golf "Tee" held between the clamping element.

The modification of the opposed gripping means 3 involve two bends, upper and lower, to form an "S" shape. The lower bend is made just above the top of the clamping element 2 toward the center approximately 45 degrees. The upper bend is made from 13 mm to 16 mm above the lower bend away from the center approximately 45 degrees. The 13 mm to 16 mm measurement of the upper bend varies with the size of the cigar and should be the same for both opposed gripping means 3 to maintain symmetry (FIG. 4). FIGS. 1 thru 5 show a large size 50 mm ordinary binder clip . Smaller binder clips can be used in order to accomodate smaller size cigars or cigarettes.

Conclusion

Accordingly, the reader will see that the cigar holder of this invention provides the golfer with a temporary place to hold a cigar or golf club secure a safely away from contact with the ground and other areas while playing the game of golf. It's also lightweight and durable enough to be transfered from one place to another very easily. It allows for a variety of cigar sizes to be held between the opposed gripping means.

I claim:

1. A smoking article holder comprising:

a binder clip, wherein said binder clip has a clamping element bent in a triangular cross-section with a top surface forming the base of the triangle, and a pair of gripping means having distal and proximal ends, the proximal ends being attached to abutting ends of said clamping element; wherein said pair of gripping means each has an upper and lower bend, forming an S-shape, said lower bend coincides with the top surface of the clamping element and extends approximately 45 degrees toward the center of said top surface, and said upper bend extends approximately 45 degrees away from the center of said top surface; and wherein said pair of gripping means is structured to secure a smoking article resting on the top surface of the clamping element.

2. The smoking article holder of claim 1, additionally including a golf tee inserted inside the abutting ends of the clamping element.

* * * * *